US007546923B2

(12) United States Patent
Abergel

(10) Patent No.: US 7,546,923 B2
(45) Date of Patent: Jun. 16, 2009

(54) AUTHENTICATABLE COSMETIC PACKAGING DEVICE

(75) Inventor: Aline Abergel, Boulogne (FR)

(73) Assignee: L'Oreal, Paris (FR)

( * ) Notice: Subject to any disclaimer, the term of this patent is extended or adjusted under 35 U.S.C. 154(b) by 316 days.

(21) Appl. No.: 10/565,776

(22) PCT Filed: Jul. 21, 2004

(86) PCT No.: PCT/EP2004/009155

§ 371 (c)(1),
(2), (4) Date: Jan. 25, 2006

(87) PCT Pub. No.: WO2005/014933

PCT Pub. Date: Feb. 17, 2005

(65) Prior Publication Data

US 2006/0175226 A1 Aug. 10, 2006

Related U.S. Application Data

(60) Provisional application No. 60/493,777, filed on Aug. 11, 2003.

(30) Foreign Application Priority Data

Jul. 25, 2003 (FR) ..... 03 09137

(51) Int. Cl.
*B65D 69/00* (2006.01)

(52) U.S. Cl. ..... 206/581; 206/823

(58) Field of Classification Search ..... 206/581, 206/807, 524.1, 524.6
See application file for complete search history.

(56) References Cited

U.S. PATENT DOCUMENTS

| | | | | |
|---|---|---|---|---|
| 3,935,960 | A | 2/1976 | Cornell | |
| 4,462,039 | A | 7/1984 | Small et al. | |
| 4,526,752 | A * | 7/1985 | Perlman et al. | 422/56 |
| 4,685,578 | A * | 8/1987 | Dunshee | 215/230 |
| 4,825,801 | A * | 5/1989 | Weber | 116/201 |
| 5,096,813 | A * | 3/1992 | Krumhar et al. | 435/28 |
| 5,508,006 | A * | 4/1996 | Gabele et al. | 422/119 |
| 5,582,328 | A * | 12/1996 | Brown | 222/23 |
| 5,617,812 | A * | 4/1997 | Balderson et al. | 116/206 |
| 6,214,766 | B1 * | 4/2001 | Kurrle | 503/201 |
| 2003/0137145 | A1 * | 7/2003 | Fell et al. | 283/72 |

FOREIGN PATENT DOCUMENTS

| | | |
|---|---|---|
| WO | 96/12659 | 5/1996 |
| WO | 03/030129 | 4/2003 |

* cited by examiner

*Primary Examiner*—Jacob K Ackun, Jr.
(74) *Attorney, Agent, or Firm*—Oblon, Spivak, McClelland, Maier & Neustadt, P.C.

(57) ABSTRACT

A packaging device for a cosmetic product includes at least one container forming at least one compartment in which the cosmetic product is directly or indirectly placed. The packaging device includes at least one authentication element incorporating at least one first chemical reagent capable, when placed in contact with a second chemical reagent present on a counterpart authentication element, of producing a detectable change in the second reagent on the counterpart authentication element. A counterfeit detection kit includes the packaging device, and a non-destructive process detects a possible counterfeit packaging device for a cosmetic product.

25 Claims, 1 Drawing Sheet

AUTHENTICATABLE COSMETIC PACKAGING DEVICE

Figure 1:
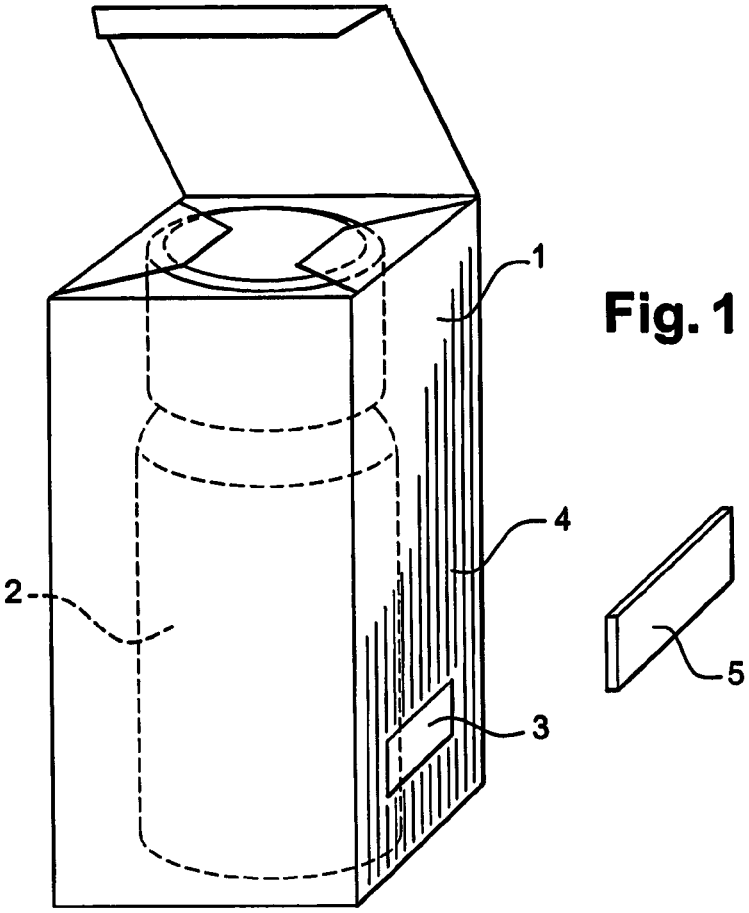

The object of the present invention is an authenticatable packaging device for cosmetics. More particularly, it finds application in the field of high value-added cosmetics packaging and packaging intended to contain high value-added cosmetic products.

Cosmetic products are almost always packaged in devices designed specifically to contain them. For a manufacturer of cosmetic products, it is essential to be able at all times to ensure optimum quality of the products that it markets. Thus, in the field of cosmetics it is important on one hand to be able to ensure the quality of a cosmetic product that is intended to be applied by millions of users worldwide, but it is also important to be in a position to ensure the functional quality of the packaging devices which protect these cosmetic products during storage. In effect, the product packaging must be optimized so that it is capable of maintaining the cosmetic characteristics of the product it contains under the best possible conditions.

The manufacturer of cosmetic products develops and creates packaging devices, each device being specifically adapted to suit the cosmetic product that it is intended to hold. These packaging devices are generally the manufacturers exclusive property, and as necessary these devices present on their external surface distinctive, unique and protected marks by which the product name, brand or any other essential information can be identified.

Manufacturers of cosmetic product are faced with problems associated with counterfeiting of their products and/or the related packaging. The most serious problem is posed by exact counterfeit copies of packaging which are of increasingly higher quality, while the products they contain are wholly substandard. Moreover, these exact copies are becoming more and more difficult to distinguish from the originals.

There is therefore a need both for the manufacturers of such cosmetic products, and also for the users of these cosmetic products, to be able to distinguish original products, which are thus compliant with an established and respected specification, from exact copies that are uncontrolled and which may even be hazardous for their users. To prevent users from being deceived when they make purchases, the devices according to the invention address this problem by being authenticatable.

In the current state of the art, document FR-2 315 132 describes known devices that can be used to protect transport documents against falsification. This type of transport document includes inscriptions written in ink on the reverse side, and the papers are coated on the front side with a reactive component. This reactive component reacts with a second component applied during the identification test so as to reveal a colour change.

Documents FR-2 279 570, U.S. Pat. No. 5,290,068 and EP-0 090 130 describe known combinations of chemical reagents capable of reacting together to obtain a visible mark on the media to be identified to which they are applied.

There is a need for the identification test not to leave marks on the packaging device of a cosmetic product, so that the latter can still be marketed, even if its authenticity has already been tested before being placed on the market. In effect, to ensure that all packaging devices for cosmetic products meet an established specification, devices whose authenticity has been tested must not be substantially different from those which have not been tested. One of the merits of the invention is to provide a means of authentication that allows the integrity of the cosmetic product packaging device to be preserved.

The invention addresses the problems posed by known systems in the current art by proposing a packaging device for a cosmetic product including at least one container forming at least one compartment in which said cosmetic product is directly or indirectly placed, and including at least one authentication element, said authentication element incorporating at least one first chemical reagent capable, when placed in contact with a second chemical reagent present on a counterpart authentication element, of producing a detectable change, notably of a visual nature, in the second reagent on the counterpart authentication element, characterised in that the second reagent is chromogenic following contact with the first reagent.

Advantageously, following contact between the first reagent and the second reagent, the authentication element produces a visible colour change locally, in particular on that part of said element incorporating the second reagent, and in the contact zone with the first reagent. The expression visible change is to be understood to mean any change that can be observed with the naked eye or that is observable visually under certain lighting conditions, for example on exposure to ultraviolet light, and/or by means of appropriate measuring instruments. For example, detection of the colour change can be accomplished by means of a calorimeter which can be used to evaluate and therefore compare colours with each other.

In particular, the new colouring can serve to reveal a code on the authentication element, this code then being compared to a given list of expected results. In particular, the expected result can be correlated with other identifiable elements on the device such as the batch number of the device. In effect, as it reacts, the second reagent can lead to the formation of an additional analysable code.

Alternatively, the second reagent can modify the surface condition, in particular the roughness or thickness of the authentication element, after being placed in contact with the first reagent presented by the device.

Preferably, after being placed in contact with an authentication element, the device remains substantially unchanged. In effect, placement of the counterpart authentication element in contact with the authentication element produces no change detectable by a consumer on the device. In addition, the second reagent preferably has no action on the parts of the device not incorporating the first reagent. Furthermore, for those parts of the device presenting this first reagent at their surface, and in particular their outer surface, placement of said part in contact with the authentication element produces no perceptible modification of the external appearance of the device. In particular, following placement in contact, no change of colour or surface condition is observable with the naked eye at the outer surface of the device.

Preferably, the location of the first reagent on the device is not visible and only an informed person is capable of carrying out the test to verify the authenticity of the device.

According to another advantageous feature of the invention, the first reagent is encapsulated. For example it can be encapsulated in small diameter microcapsules. In this case, the authentication element preferably includes a third chemical reagent capable of breaking the capsules enclosing the first reagent thereby initiating, as appropriate, the reaction between the first reagent and the second reagent.

In a first embodiment, the first reagent is at least partially imprinted on a portion of the external surface of the device. In a second embodiment, the first reagent is at least partially integrated into the mass of the device, i.e. integrated into the material forming all or part of the container incorporating said authentication element.

Advantageously, the counterpart authentication element includes an adhesive substance capable of adhering to the device in a reversible manner. This feature enables the test to be left to proceed without effort on the part of the person in charge of testing the authenticity of the device. In addition, this arrangement allows prolonged contact to be maintained in the case where the reaction which must take place between the first reagent and the second reagent takes a long time before the test results can be read off the authentication element once it has been detached, and to determine whether or not the device thus tested is authentic.

In the invention, the authentication element can, for example, be presented on a secondary outer packaging of the cosmetic product, this type of packaging being considered secondary in that it does not come into direct contact with the cosmetic product. Secondary packaging is for example a box, a plastic film or a leaflet. At the same time, the authentication element can also be presented on the primary packaging of the cosmetic product, in which case, the first reagent is presented on a portion of the outer surface of the device so as to be readily accessible and to allow the authentication test to be performed. In addition, it is presented on this outer surface so as not to interact with the product directly contained in the primary packaging.

The portion of the external surface incorporating said authentication element can be placed directly on or in the material forming all or part of the container. As a variant, it can be mounted, for example in the form of a label or cap, relative to a part of the container.

The cosmetic product is understood to be any liquid, paste or solid formulation having a cosmetic and/or beauty care function. Cosmetic requisites such as brushes or other items are also included in the definition of a cosmetic product.

For example, a packaging device according to the invention includes a bottle fitted with a cap designed to contain a liquid formulation. This bottle, complete with label and closed by its cap, is placed in a cardboard box which is in turn protected by a plastic film. For example, each of the following elements: bottle, label, cap, box and plastic film, presents at least one authentication element. These authentication elements are, for example, all different, each being capable of reacting with a specific counterpart reagent.

Advantageously, the combination formed by the first reagent and the second reagent is a unique chemical combination. That is to say the first reagent is capable of reacting only with said second reagent. Preferably, the chemical composition of these reagents is kept secret at the time when the devices incorporating reagents such as the first reagent are placed on the market. To this end, the first reagent is preferably invisible or carefully arranged in a motif of the same colour as that provided for the presentation or decoration of the device.

In particular, reagents capable of performing the function of the first reagent are colour developers, selected for example from the following list of organic acids: maleic, malonic, succinic, glutaric, adipic, tricarballylic, diglycolic, lactic, malic, tartaric and citric acids. In a complementary manner, the reagents capable of performing the function of the second reagent are in particular colourant formers, for example selected from the range of CIBA Geigy products including the following products: a bisindolylphtalide compound marketed under the brand name Pergascript Red I-6B, or an aminofluorane compound marketed under the brand name Pergascript Orange I-G, or a phtalide compound marketed under the brand name Pergascript Blue 2-RN, or a diaminofluorane compound marketed under the brand name Pergascript Black I-R.

In particular, a further object of the invention is to provide a counterfeit detection kit for a device wherein the authentication element takes the form of a strip supplied separately from the device to be authenticated.

A further object of the invention is to provide a non-destructive process for authentication and detection of possible counterfeiting of a packaging device for a cosmetic product, the process including the following steps:

i) place an authentication element of a packaging device such as previously described in contact with a counterpart authentication element incorporating a second reagent which, when it is in contact with the first reagent present on the authentication element on the device, is modified in a detectable manner, notably visually; and ii) detect any change in the reagent present on the counterpart authentication element, the absence of change in the second reagent indicating that the device is not authentic.

According to this test process, in particular, a device is considered an original when the authentication element applied thereto presents an expected detectable change, this change indicating the presence of a first reagent on this surface, said first reagent being uniquely capable of causing the formulation of the authentication element to react.

Advantageously, when the first reagent is encapsulated, the physical contact between the device and the authentication element must be forceful enough to ensure that the microcapsules break. The counterpart authentication element is then applied against the authentication element under conditions, notably of force, capable of causing the capsules containing the first reagent to break. For example, the authentication element is rubbed over the area of the device presenting these microcapsules. Alternatively, breakage of the microcapsules can be accomplished chemically by means of a catalyst thus capable of releasing the first reagent. In another alternative, breakage of the capsules can be obtained by modifying the temperature conditions of the first reagent, for example by applying heat.

Advantageously, following analysis, the medium constituting the authentication element is discarded if a change, notably a change of colour, is observed.

Figure 2:
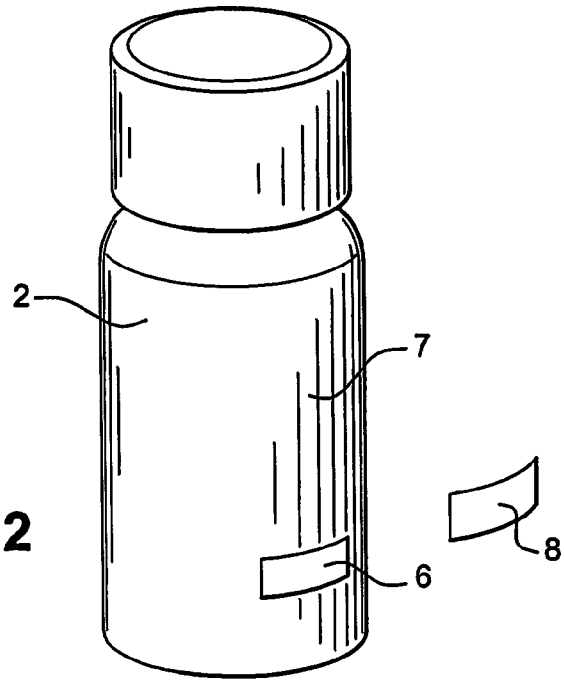

The invention will be better understood by reading the following description and by reference to the accompanying figures. These are given for guidance only and are in no way limitative of the invention. The figures show:

FIG. 1: a first embodiment of a device according to the invention capable of cooperating with a counterpart authentication element;

FIG. 2: a second embodiment of a device according to the invention capable of cooperating with a second counterpart authentication element.

FIG. 1 shows a device 1 forming a box, made of cardboard, for example. This box includes a flap selectively affording access to the interior. A bottle 2 is protected inside the box in FIG. 1, the bottle 2 being designed to receive a cosmetic product.

The device 1 includes an area 3 on its outer surface 4 at which a first reagent is presented flush with this outer surface if the device 1 is an authentic original.

To authenticate the device 1, a strip 5 presenting the second reagent on at least one of its faces is applied to the area 3. Contact is maintained for a sufficient length of time for a chemical reaction, if any, to take place between the second reagent and the first reagent.

If a result is observed in the form of a chemical reaction, for example a change of colour, in the areas of the strip 5 impregnated with the second reagent and placed in contact with the area 3, then the result is positive. The device thus tested is not a counterfeit in that it reveals an indicator that only the official manufacturer of said product could have provided. However, if no change is observed in the strip 5, then the device tested is not an original and constitutes a counterfeit if in other respects it reproduces the characteristics of a duly protected product.

In FIG. 2, as a variant, the bottle 2 itself presents a second area 6 on the outer surface of the portion 7 forming the receptacle for the cosmetic product. To authenticate the bottle 2, a second strip 8 is applied, this strip 8 being flexible, against the second area 6.

Preferably, the area 6 incorporates another reagent different from the first reagent in the first area 3. This other different reagent is capable of reacting with the counterpart reagent provided on the second strip while it is incapable of reacting with the second reagent presented on the first strip 5.

The invention claimed is:

1. A kit comprising:

i) a packaging device comprising, a cosmetic product;

at least one container forming at least one compartment in which said cosmetic product is directly or indirectly placed, said container being configured to fit inside said packaging device;

at least one authentication element on an outer surface of said packaging device or of said container, said authentication element incorporating at least one first chemical reagent having a composition such that, when placed in contact with a second chemical reagent present on a counterpart authentication element, said first chemical reagent produces a detectable change in the second chemical reagent on the counterpart authentication element; and ii) a strip supporting said counterpart authentication element incorporating said second chemical reagent which has a composition such that, when placed in contact with said first chemical reagent on said authentication element of the device, said second chemical reagent is modified in a detectable manner, and wherein the composition of the second chemical reagent is such that the second chemical reagent is chromogenic following contact with the first chemical reagent.

2. A kit according to claim 1, wherein said composition of said first chemical reagent is such that, following contact between the first chemical reagent and the second chemical reagent, the authentication element produces a visible color change locally.

3. A kit according to claim 1, wherein said composition of said first chemical reagent is such that placement of the authentication element in contact with the counterpart authentication element produces no visible change on the device.

4. A kit according to claim 1, wherein the first chemical reagent is encapsulated.

5. A kit according to claim 4, wherein the authentication element includes a third chemical reagent capable of breaking capsules enclosing the first chemical reagent.

6. A kit according to claim 1, wherein the first chemical reagent is at least partially imprinted on a portion of an external surface of the container.

7. A kit according to claim 1, wherein the first chemical reagent is integral with a material forming all or part of the container incorporating said authentication element.

8. A kit according to claim 1, wherein said authentication element is such as to reversibly adhere to the counterpart authentication element via an adhesive substance.

9. A kit according to claim 1, wherein the authentication element is on a receptacle constituting a secondary outer package indirectly containing said cosmetic product.

10. A kit according to claim 1, wherein the authentication element is on a receptacle constituting a primary package directly containing said cosmetic product.

11. A kit according to claim 1, wherein said composition of said first chemical reagent is such that, as said second chemical reagent reacts, the second chemical reagent leads to the formation of an additional analyzable code.

12. A kit according to claim 1, wherein said composition of said first chemical reagent is such that a combination formed by the first chemical reagent and the second chemical reagent is a unique chemical combination.

13. A kit according to claim 1, wherein said composition of said first chemical reagent is such that said detectable change is of a visual nature.

14. A kit according to claim 1, wherein said composition of said second chemical reagent is such that said second chemical reagent is visually modified when in contact with the first chemical reagent.

15. A kit according to claim 1, wherein said composition of said first chemical reagent comprises a color developer.

16. A kit according to claim 15, wherein said composition of said first chemical reagent comprises an organic acid.

17. A kit according to claim 15, wherein said composition of said first chemical reagent comprises an organic acid selected from the group consisting of maleic, malonic, succinic, glutaric, adipic, tricarballylic, diglycolic, lactic, malic, tartaric and citric acids.

18. A kit according to claim 1, wherein said composition of said first chemical reagent comprises a color developer; and said second chemical reagent is a colorant former.

19. A kit according to claim 18, wherein said composition of said first chemical reagent comprises an organic acid selected from the group consisting of maleic, malonic, succinic, glutaric, adipic, tricarballylic, diglycolic, lactic, malic, tartaric and citric acids; and wherein said second chemical reagent is selected from the group consisting of a bisindolylphtalide compound, a aminofluorane compound, a phtalide compound, and a diaminofluorane compound.

20. A kit according to claim 1, wherein said at least one authentication element is a first authentication element placed on the outer surface of said packaging device, wherein said container includes a second authentication element, wherein said strip is a first strip, said counterpart authentication element is a first counterpart authentication element and said kit includes a second strip with a second counterpart authentication element, wherein said first authentication elements is configured to react with said first counterpart authentication element, and said second authentication elements is configured to react with said second counterpart authentication element.

21. A kit according to claim 20, wherein said second authentication elements is configured to not react with said first counterpart authentication element.

22. An authentication process for a packaging device for a cosmetic product, the process comprising the following steps:

providing a packaging device including a cosmetic product, at least one container forming at least one compartment in which said cosmetic product is directly or indirectly placed, and at least one authentication element on an outer surface of said packaging device or of said container, said authentication element incorporating at least one first chemical reagent having a composition such that, when placed in contact with a second chemical reagent present on a counterpart authentication element, said first chemical reagent produces a detectable change in the second chemical reagent on the counterpart authentication element;

placing said authentication element of said packaging device in contact with a strip supporting said counterpart authentication element incorporating said second chemical reagent which, when in contact with the first chemical reagent present on the authentication element on the device, is modified in a detectable manner; and detecting any change in the second chemical reagent present on the counterpart authentication element, the absence of change in the second chemical reagent indicating that the device is not authentic.

23. A process according to claim 22, wherein the first chemical reagent is encapsulated, the counterpart authentication element being applied against the authentication element under conditions capable of causing the capsules containing the first chemical reagent to break.

24. A process according to claim 22, wherein the counterpart authentication element is discarded when a change is detected.

25. A process according to claim 22, wherein the second chemical reagent is visually modified when in contact with the first chemical reagent.

* * * * *